US010994926B2

(12) United States Patent
Eiler

(10) Patent No.: US 10,994,926 B2
(45) Date of Patent: May 4, 2021

(54) VACUUM-INTEGRATED TRASH BIN

(71) Applicant: John Eiler, Milltown, IN (US)

(72) Inventor: John Eiler, Milltown, IN (US)

( * ) Notice: Subject to any disclaimer, the term of this patent is extended or adjusted under 35 U.S.C. 154(b) by 3 days.

(21) Appl. No.: 16/288,988

(22) Filed: Feb. 28, 2019

(65) Prior Publication Data

US 2020/0017292 A1 Jan. 16, 2020

Related U.S. Application Data

(60) Provisional application No. 62/696,374, filed on Jul. 11, 2018.

(51) Int. Cl.
*B65D 25/14* (2006.01)
*B65F 1/06* (2006.01)
*B65F 1/08* (2006.01)

(52) U.S. Cl.
CPC ..... *B65F 1/065* (2013.01); *B65F 1/08* (2013.01); *B65F 2210/179* (2013.01)

(58) Field of Classification Search
CPC .... B65F 1/065; B65F 1/08; B65F 1/06; B65F 1/068; B65F 1/163; B65F 2210/179
USPC ..... 220/23.87, 495.01, 495.04, 495.06, 220/495.08, 908, 908.1
See application file for complete search history.

(56) References Cited

U.S. PATENT DOCUMENTS

| | | | | |
|---|---|---|---|---|
| 4,294,379 | A | 10/1981 | Bard | |
| 5,375,732 | A | 12/1994 | Bowers et al. | |
| 9,027,778 | B1 * | 5/2015 | Slawinski, Jr. | B65F 1/06 220/495.04 |
| 2006/0175336 | A1 * | 8/2006 | Wang | B65F 1/163 220/495.04 |
| 2007/0068947 | A1 | 3/2007 | Rush | |
| 2009/0255934 | A1 | 10/2009 | Herndon | |
| 2011/0100997 | A1 * | 5/2011 | Gagnebin | B65F 1/08 220/495.04 |

* cited by examiner

*Primary Examiner* — James N Smalley
*Assistant Examiner* — Elizabeth J Volz
(74) *Attorney, Agent, or Firm* — Boudwin Intellectual Property; Daniel Boudwin

(57) ABSTRACT

A vacuum-integrated trash bin. The vacuum-integrated trash bin includes a housing dimensioned to be removably insertable into a trash bin to form a seal. The housing includes a plurality of apertures in the sidewalls of the housing and a port at the bottom surface of the housing. The port is positioned above a vacuum pump, such that actuation of the vacuum pump sucks air through the apertures of the housing to conform a trash bag placed within the housing to the shape of the housing, thereby increasing an internal volume of the trash bag.

7 Claims, 5 Drawing Sheets

VACUUM-INTEGRATED TRASH BIN

CROSS REFERENCE TO RELATED APPLICATIONS

This application claims the benefit of U.S. Provisional Application No. 62/696,374 filed on Jul. 11, 2018. The above identified patent application is herein incorporated by reference in its entirety to provide continuity of disclosure.

BACKGROUND OF THE INVENTION

The present invention relates to a vacuum-integrated trash bin. Specifically, a vacuum-integrated trash bin having a vacuum pump configured to maximize an internal volume of a trash bag installed within an interior of the vacuum-integrated trash bin.

Traditional trash bins and trash cans require manual application of a trash bag. Typically, a user must unwrap, unfurl or unroll a trash bag, such that the trash bag is in an open position before placing the trash bag into the trash bin or trash can and securing the mouth of the trash bag to the rim of the trash bin or trash can. This process can be inconvenient for a user, especially when placing a trash bag into a large trash bin or trash can. Older trash receptacles, particularly, may be odorous and cause discomfort to a user when replacing a trash bag.

Older persons and persons with physical limitations may also struggle with the physical requirements of replacing a trash bag, as they may be required to bend over and reach their arms into the trash can or trash bin to maximize the interior volume of the trash bag within the trash can or trash bin, such that the trash bag will entirely fill the volume of the trash bin or trash can.

Therefore, there is need for a trash receptacle that provides users the ability to simply and effectively replace a trash bag in a trash can or trash bin, while also maximizing the volume of the trash bag for use.

SUMMARY OF THE INVENTION

In view of the foregoing disadvantages inherent in the known types of trash bins or trash cans now present in the known art, the present invention provides a vacuum-integrated trash bin wherein the same can be utilized for providing convenience for the user when replacing a trash bag in a trash can or trash bin.

The present system comprises a housing defined by a base with a plurality of sidewalls that extend upward from the base. The housing is dimensioned to be removably insertable into a larger trash bin. A plurality of apertures is disposed in the plurality of sidewalls of the housing. A port is disposed through the base of the housing. A vacuum pump is disposed on a bottom surface of the trash bin. The vacuum pump is in operable connection with the port. An actuator is in operable connection with the vacuum pump. An interface is formed between the housing and trash bin, such that when the housing is inserted into the trash bin, a seal is formed between the housing and the trash bin.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings, wherein like numeral annotations are provided throughout.

DETAILED DESCRIPTION OF THE INVENTION

Figure 1:
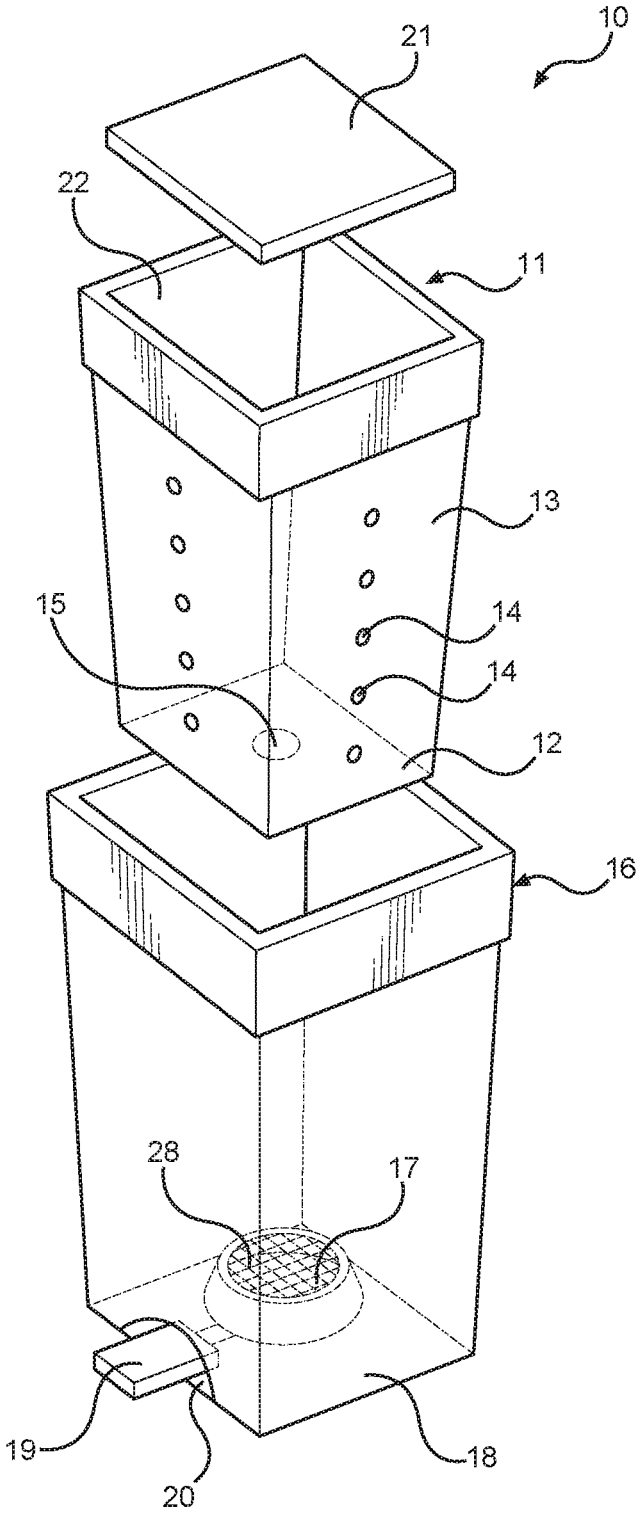
FIG. 1 shows an exploded view of the vacuum-integrated trash bin.

Reference is made herein to the attached drawings. Like reference numerals are used throughout the drawings to depict like or similar elements of the vacuum-integrated trash bin. The figures are intended for representative purposes only and should not be considered to be limiting in any respect.

Referring now to FIG. 1, there is shown an exploded view of the vacuum-integrated trash bin. A vacuum-integrated trash bin 10 comprises a housing 11. The housing 11 is defined by a base 12 with a plurality of sidewalls 13 extending upward from the base 12. The plurality of sidewalls 13 extending upward from the base 12 define a volume dimensioned to receive a trash bag.

A plurality of apertures 14 are disposed in the plurality of sidewalls 13 of the housing 11. In the illustrated embodiment, the plurality of apertures 14 comprise a plurality of corresponding apertures disposed symmetrically on a pair of opposing sidewalls 13 of the housing 11. Through symmetric disposition of the plurality of apertures 14, it is ensured that a trash bag will be evenly held against the sidewalls 13 of the housing. A port 15 is disposed through the base 12 of the housing 11, such that access is provided to the housing 11 by air currents. Additionally, the port 15 provides assistance to the user when cleaning the housing 11.

The housing 11 is dimensioned to be removably inserted into a trash bin 16. Specifically, the perimeter defined by the housing 11 is less than the perimeter defined by the trash bin 16. As such, the housing 11 is freely insertable into the trash bin 16, such that the housing 11 can act as a liner for the trash bin 16.

A vacuum pump 17 is disposed on a bottom surface 18 of the trash bin 16. The vacuum pump 17 is in operable connection with the port 15 when the housing 11 is placed into the trash bin 16. An actuator 19 is in operable connection with the vacuum pump 17. The actuator 19 is configured to actuate the vacuum pump 17, such that when a user engages the actuator 19, the vacuum pump 17 will begin to exert a suction force. In the illustrated embodiment, the actuator 19 is a foot pedal disposed extending from a bottom portion of the trash bin 16. Furthermore, in the illustrated embodiment, the foot pedal is disposed in an actuator housing 20 at a bottom end of the trash bin 16.

In the illustrated embodiment, the vacuum-integrated trash bin 10 further comprises a lid 21. In the illustrated embodiment, the lid 21 is configured to be removably securable to an open upper end 22 of the housing 11. Furthermore, the lid 21 is shown to be fully and entirely removable from the open upper end 22 of the housing 11. In an alternate embodiment, the lid may be movably secured to the open upper end 22 of the housing 11 or to an open upper end of the trash bin 16, such as via a device such as a hinge or a latch. In a further embodiment, the lid 22 may comprise at least one hole therein, such that the vacuum pump can be operated while the lid 21 is secured to the open upper end 22 of the housing.

In the illustrated embodiment, the vacuum pump 16 further comprises a plurality of bars 28 defining a grid disposed over the port. The grid is configured to prevent the entrance of a garbage bag into the vacuum pump 17. When the garbage bag or large debris enters the vacuum pump 17, the risk of damage thereto is increased.

Figure 2:
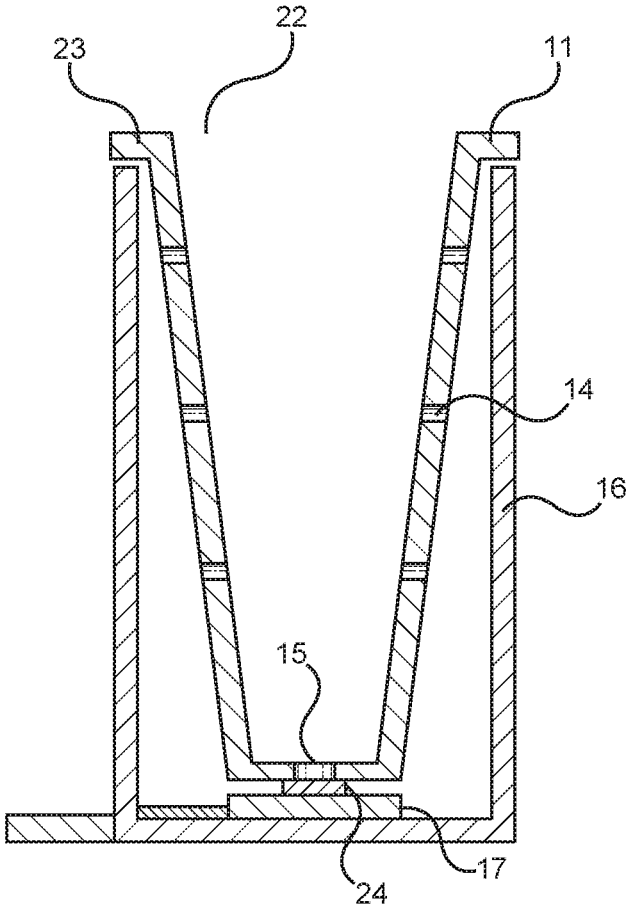
FIG. 2 shows a cross-sectional view of the vacuum-integrated trash bin.

Referring now to FIG. 2, there is shown a cross-sectional view of the vacuum-integrated trash bin. In the illustrated embodiment, the housing 11 is removably inserted into the trash bin 16. Specifically, the housing 11 defines an overhang 23 around the open upper end 22. The overhang 23 rests directly on the open upper end of the trash bin 16, such that a seal is formed between the trash bin 16 and the housing 11. With the seal formed, the suction applied by the vacuum pump 17 is exerted through the plurality of apertures in the housing 11, such that a trash bag is evenly unfurled in the housing 11.

In the illustrated embodiment, the vacuum-integrated trash bin 10 comprises a hose 24 extending from the vacuum pump 17 to the port 15. The hose 24 is configured to provide air current directly to the port 15, thus preventing air flow dilution into the area surrounding the vacuum pump 17.

Figure 3:
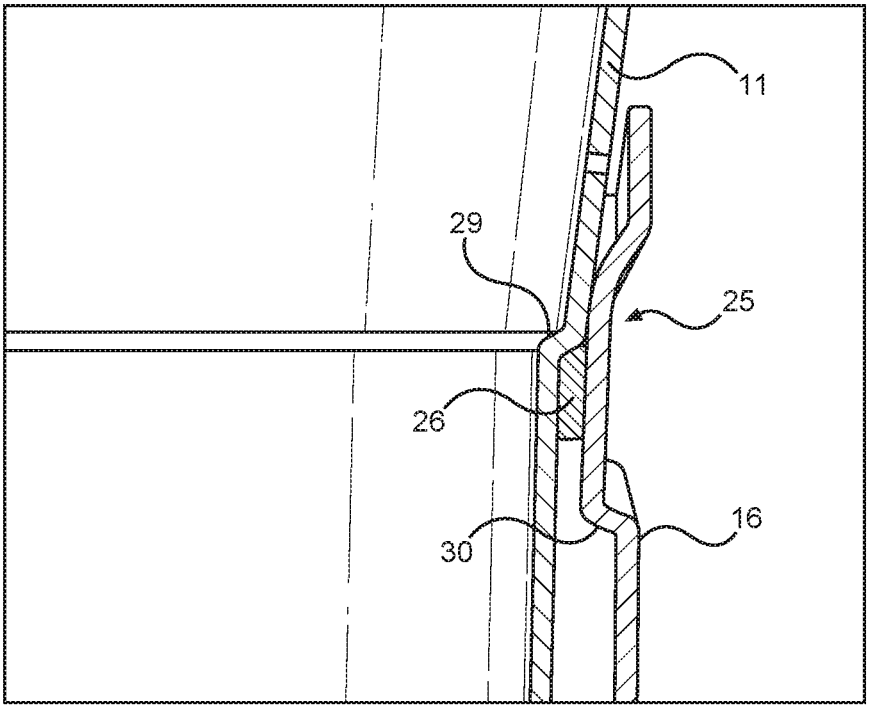
FIG. 3 shows a close-up view of an interface of an embodiment of the vacuum-integrated trash bin.

Referring now to FIG. 3, there is shown a close-up view of an interface of an embodiment of the vacuum-integrated trash bin. The housing 11 defines an interface 25. The interface 25 is configured to form a seal between the housing 11 and the trash bin 16. In the illustrated embodiment, the interface comprises a rubberized flange 26 disposed around a perimeter of the housing 11 between the housing 11 and the trash bin 16. A lip 30 is disposed on the internal surface of the housing. The rubberized flange 26 is disposed on the lip 30, such as to form a seal between the overhang and the rubberized flange 26.

Figure 4A:
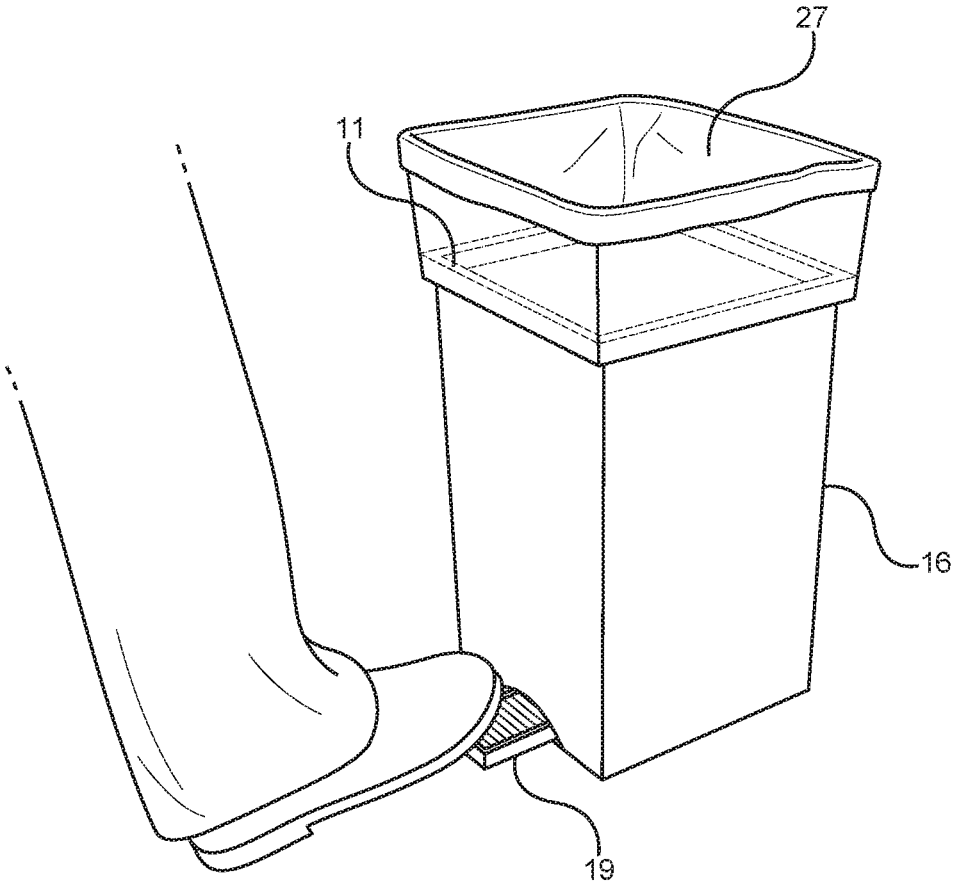
FIG. 4A shows a view of an embodiment of the vacuum-integrated trash bin during use.
Figure 4B:
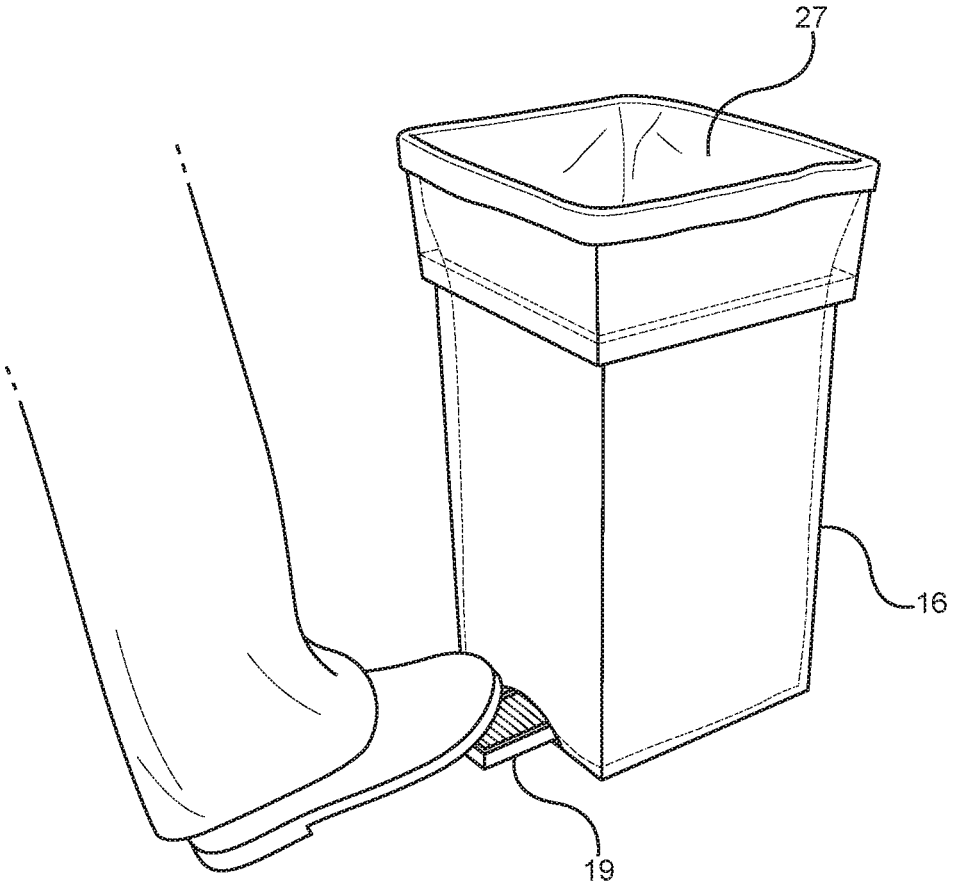
FIG. 4B shows a view of an embodiment of the vacuum-integrated trash bin after use.

Referring now to FIGS. 4A and 4B, there is shown a pair of in use views of an embodiment of the vacuum-integrated trash bin. In use, a garbage bag 27 is disposed over the housing 11. The housing 11 is inserted into the trash bin 16. Once the housing 11 is inserted into the trash bin 16, as shown in FIG. 4A, the actuator 19 is actuated such that the vacuum pump is actuated. When the vacuum pump is actuated, the garbage bag 27 is pulled downward and outward by the air current and held in a flush position relative to the housing. Releasing the actuator 19 stops the vacuum pump.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vacuum-integrated trash bin, comprising:

a housing defined by a base with a plurality of sidewalls extending upward therefrom;

the housing dimensioned to be removably inserted into a trash bin;

a plurality of apertures disposed in the plurality of sidewalls of the housing;

a port disposed through the base of the housing;

a vacuum pump disposed on a bottom surface of the trash bin in operable connection with the port;

an actuator in operable connection with the vacuum pump;

the housing defining an interface on an external surface thereof;

the interface configured to form a seal between the housing and the trash bin;

the interface comprising an overhang disposed on an external surface of the housing;

a lip disposed on an internal surface of the trash bin;

a rubberized flange disposed on the lip, such as to form a seal between the overhang and the rubberized flange.

2. The vacuum-integrated trash bin of claim 1, wherein the actuator comprises a foot pedal extending from a bottom portion of the trash bin.

3. The vacuum-integrated trash bin of claim 1, wherein the plurality of apertures comprises a plurality of corresponding apertures disposed symmetrically on a pair of opposing sidewalls of the housing.

4. The vacuum-integrated trash bin of claim 1, further comprising a lid removably securable upon an open upper end of the housing.

5. The vacuum-integrated trash bin of claim 1, further comprising a hose extending from the vacuum pump to the port.

6. The vacuum-integrated trash bin of claim 1, further comprising a plurality of bars forming a grid disposed over the port.

7. The vacuum-integrated trash bin of claim 1, wherein each aperture of the plurality of apertures is circular in shape.

* * * * *